US009242469B2

(12) United States Patent
Okina

(10) Patent No.: US 9,242,469 B2
(45) Date of Patent: Jan. 26, 2016

(54) LIQUID EJECTING APPARATUS AND MAINTENANCE METHOD

(71) Applicant: SEIKO EPSON CORPORATION, Tokyo (JP)

(72) Inventor: Takuya Okina, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/533,732

(22) Filed: Nov. 5, 2014

(65) Prior Publication Data

US 2015/0130872 A1 May 14, 2015

(30) Foreign Application Priority Data

Nov. 13, 2013 (JP) ..... 2013-235376

(51) Int. Cl.
*B41J 2/165* (2006.01)
*B41J 2/19* (2006.01)

(52) U.S. Cl.
CPC ..... *B41J 2/16526* (2013.01); *B41J 2/16508* (2013.01); *B41J 2/16523* (2013.01); *B41J 2/16532* (2013.01); *B41J 2/19* (2013.01)

(58) Field of Classification Search
CPC ..... B41J 2/19; B41J 2202/07; B41J 2/16526; B41J 2/1652
See application file for complete search history.

(56) References Cited

U.S. PATENT DOCUMENTS

2003/0001920 A1 1/2003 Harada et al.
2003/0146958 A1 8/2003 Aruga et al.
2011/0298875 A1* 12/2011 Kobashi et al. ..... 347/92

FOREIGN PATENT DOCUMENTS

JP 2001-001554 1/2001
JP 2005-225163 8/2005
JP 2007-015409 1/2007

* cited by examiner

*Primary Examiner* — Geoffrey Mruk
(74) *Attorney, Agent, or Firm* — Workman Nydegger

(57) ABSTRACT

A liquid ejecting apparatus includes: a liquid ejecting section in which a nozzle capable of ejecting liquid is provided; a supply flow path that supplies the liquid to the nozzle; a pressurizing mechanism that discharges the liquid from the nozzle by pressurizing the liquid inside the supply flow path; and a pressure reducing mechanism that discharges the liquid from the nozzle by reducing a pressure of a space communicating with a side opposite to a side of the supply flow path of the nozzle. In a maintenance operation discharging the liquid from the nozzle by driving at least one of the pressurizing mechanism and the pressure reducing mechanism, the last discharging operation of the maintenance operation is performed by driving the pressurizing mechanism from a state where the negative pressure is caused to act on the inside of the nozzle by driving the pressure reducing mechanism.

4 Claims, 6 Drawing Sheets

LIQUID EJECTING APPARATUS AND MAINTENANCE METHOD

BACKGROUND

1. Technical Field

The present invention relates to a liquid ejecting apparatus and a maintenance method of, for example, a printer and the like.

2. Related Art

In the related art, as an example of a liquid ejecting apparatus, there is an ink jet type printer including a recording head ejecting ink droplets from a nozzle opening and a capping unit performing a cleaning operation that sucks and discharges ink from the nozzle opening. In such a printer, a technique is known for discharging air bubbles with liquid from the nozzle opening by sucking the air bubbles, after expanding the air bubbles present in an ink flow path inside the recording head by maintaining for a predetermined time a state where a negative pressure is accumulated in an internal space of the capping unit that seals the nozzle opening (for example, JP-A-2001-1554).

However, in the above technique, in the recording head, it is possible to efficiently discharge the air bubbles in a downstream portion of the ink flow path close to the nozzle opening, but the cleaning operation may be completed while the air bubbles in an upstream portion of the ink flow path have not reached the nozzle opening. Then, there is a problem that the air bubbles expanded by maintaining a state where the negative pressure is accumulated remain in the ink flow path and discharge failure of the ink occurs despite completion of the cleaning operation.

SUMMARY

An advantage of some aspects of the invention is to provide a liquid ejecting apparatus that is capable of reducing air bubbles remaining in a supply flow path that supplies liquid to a nozzle after performing maintenance of discharging of the liquid from the nozzle and a maintenance method.

Hereinafter, means of the invention and operation effects thereof will be described.

According to an aspect of the invention, there is provided a liquid ejecting apparatus including: a liquid ejecting section in which a nozzle capable of ejecting liquid is provided; a supply flow path that supplies the liquid to the nozzle; a pressurizing mechanism that discharges the liquid from the nozzle by pressurizing the liquid inside the supply flow path; and a pressure reducing mechanism that discharges the liquid from the nozzle by reducing a pressure of a space communicating with a side opposite to a side of the supply flow path of the nozzle. In a maintenance operation of discharging the liquid from the nozzle by driving at least one of the pressurizing mechanism and the pressure reducing mechanism, the last discharging operation of the maintenance operation is performed by driving the pressurizing mechanism from a state where the negative pressure is caused to act inside the nozzle by driving the pressure reducing mechanism.

When the negative pressure is caused to act on the liquid inside the nozzle by driving the pressure reducing mechanism, since the air bubbles mixed into the supply flow path are expanded, particularly, the air bubbles in the downstream portion of the supply flow path are likely to be discharged with the liquid from the nozzle. However, when the negative pressure is caused to act on the inside of the supply flow path by driving the pressure reducing mechanism, gas dissolved in the liquid becomes air bubbles and appears as air bubbles.

Then, the air bubbles appearing in the upstream portion of the supply flow path about at the time of an end of the maintenance operation may remain in the supply flow path after the maintenance operation.

In this case, since the liquid is pressurized and discharged by driving the pressurizing mechanism without performing the suction and discharge of the liquid by the pressure reducing mechanism about at the time of the end of the maintenance operation, the air bubbles are not generated about at the time of the end of the maintenance operation and the air bubbles inside the supply flow path are swept away to the downstream side, and the air bubbles can be discharged from the nozzle together with the liquid. Therefore, it is possible to reduce the air bubbles remaining in the supply flow path that supplies the liquid to the nozzle after performing the maintenance in which the liquid is discharged from the nozzle. "Negative pressure" refers to a state where the pressure is lower than atmospheric pressure.

In the liquid ejecting apparatus, the first discharging operation may be performed by driving the pressure reducing mechanism in the maintenance operation.

In this case, it is possible to efficiently expand the air bubbles in the supply flow path by performing the first discharging operation of the maintenance operation by driving the pressure reducing mechanism. Therefore, it is possible to efficiently discharge the air bubbles according to the discharge of the liquid.

In the liquid ejecting apparatus, the discharging operation between the first discharging operation and the last discharging operation may be performed by driving the pressurizing mechanism and the pressure reducing mechanism in the maintenance operation.

In this case, the pressure corresponding to the pressure difference between the positive pressure generated by the pressurization of the pressurizing mechanism and the negative pressure generated by the pressure reduction of the pressure reducing mechanism is applied to the liquid inside the supply flow path by driving both the pressurizing mechanism and the pressure reducing mechanism. As described above, when applying the pressure corresponding to the pressure difference between the positive pressure and the negative pressure only by the pressurization or only by the pressure reduction, the pressure difference between the inside of the supply flow path and the outside thereof increases. Thus, there is a concern that the load on the supply flow path may increase, thereby leading to the leakage of the liquid or the deformation and the like of the supply flow path. On the other hand, it is possible to improve the discharge property of the air bubbles by increasing the flow rate of the liquid while suppressing the load applied to the supply flow path by causing the pressure difference between the positive pressure and the negative pressure to act on the liquid inside the supply flow path by driving both the pressurizing mechanism and the pressure reducing mechanism at the same time. Moreover, "positive pressure" refers to a state where the pressure is higher than atmospheric pressure.

In the liquid ejecting apparatus, an upstream end of the supply flow path may be connected to a liquid supply source and the supply flow path may be provided with a width widened section in which a cross-sectional area of the flow path is widened. The pressurizing mechanism may be disposed in a position further upstream than the width widened section in the supply flow path.

In this case, since the width widened sections are enlarged in the cross-sectional areas of the flow path, the air bubbles are likely to be accumulated, but it is possible to efficiently sweep away the air bubbles accumulated in the width widened sections to the downstream side of the nozzle by the pressurizing mechanism pressurizing and supplying the liquid from further upstream than the width widened sections.

According to another aspect of the invention, there is provided a maintenance method in a liquid ejecting apparatus which includes a liquid ejecting section in which a nozzle capable of ejecting liquid is provided; a supply flow path that supplies the liquid to the nozzle; a pressurizing mechanism that discharges liquid from the nozzle by pressurizing the liquid inside a supply flow path; and a pressure reducing mechanism that discharges the liquid from the nozzle by reducing a pressure of a space communicating with a side opposite to a side of the supply flow path of the nozzle, and in which the liquid is discharged from the nozzle by driving at least one of the pressurizing mechanism and the pressure reducing mechanism, the method including: causing the negative pressure to act on the nozzle by driving the pressure reducing mechanism; and discharging the liquid from the nozzle by driving the pressurizing mechanism, after the operating of the negative pressure.

In this case, it is possible to obtain the same operational effects as those of the liquid ejecting apparatus described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting apparatus will be described with reference to the drawings.

The liquid ejecting apparatus is, for example, an ink jet type printer that performs printing by ejecting ink that is one example of liquid on a medium such as a sheet.

Figure 1:
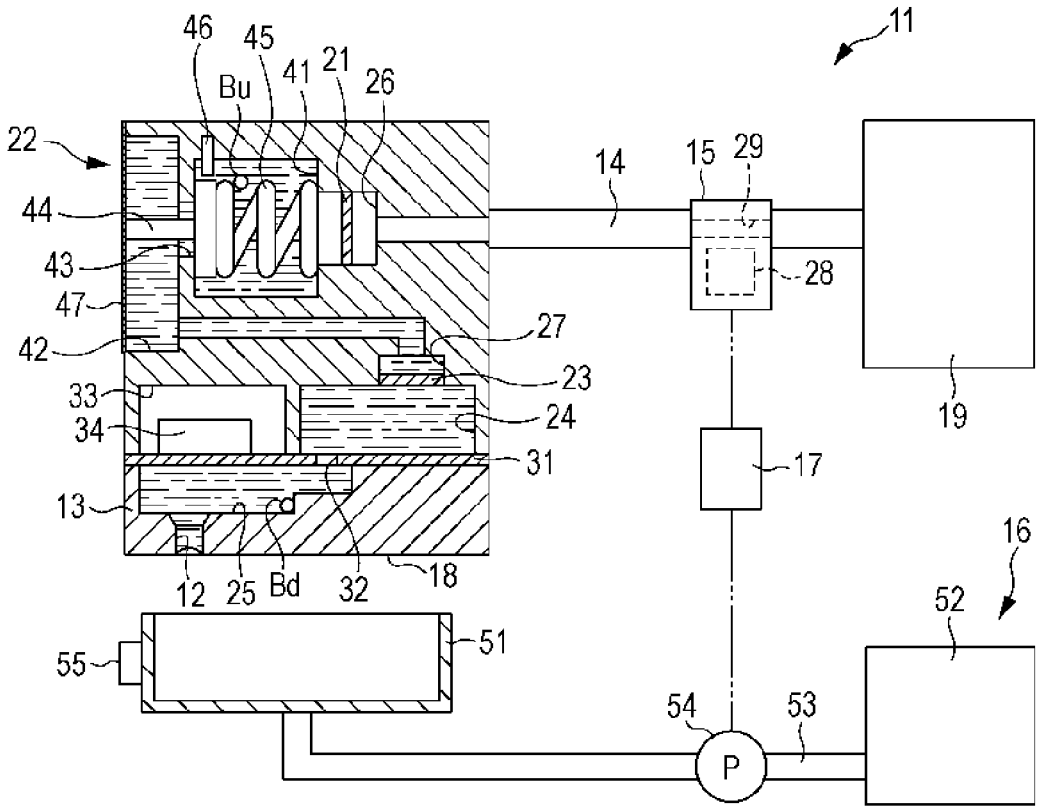
FIG. 1 is a cross-sectional view illustrating a schematic configuration of a liquid ejecting apparatus of an embodiment.

As illustrated in FIG. 1, a liquid ejecting apparatus 11 includes a liquid ejecting section 13 in which a nozzle 12 capable of ejecting liquid is provided, a supply flow path 14 that supplies the liquid to the nozzle 12, a pressurizing mechanism 15 that pressurizes the liquid inside the supply flow path 14, a maintenance mechanism 16, and a control section 17 that controls the pressurizing mechanism 15 and the maintenance mechanism 16. Moreover, the control section 17 may perform control together with control of the liquid ejecting section 13.

In the embodiment, for example, a plurality of nozzles 12 are provided in the liquid ejecting section 13 so as to be arranged in a direction orthogonal to a sheet surface in FIG. 1. Then, a downstream end (the opposite end to a side of the supply flow path 14) of the plurality of nozzles 12 is open to a nozzle forming surface 18 provided in the liquid ejecting section 13.

First, a configuration of the supply flow path 14 and the liquid ejecting section 13 will be described.

An upstream end of the supply flow path 14 is connected to a liquid supply source 19 that stores the liquid. The liquid supply source 19 may be a cartridge that is detachably mounted on the liquid ejecting apparatus 11 and may be a liquid storage tank that is provided in the liquid ejecting apparatus 11. Otherwise, the liquid supply source 19 is a liquid storage container that is provided on the outside of the liquid ejecting apparatus 11 as a separate body and may be connected to the supply flow path 14 configuring the liquid ejecting apparatus 11 through a liquid supplying tube and the like through an adapter and the like.

A first filter 21, a pressure adjustment mechanism 22, a second filter 23, a reservoir 24, and a cavity 25 are provided between the pressurizing mechanism 15 and the nozzle 12 in the supply flow path 14 so as to be arranged from the upstream side to the downstream side. The reservoir 24 and the cavity 25 are separated by a vibration plate 31, and communicate with each other through a through hole 32 formed in the vibration plate 31.

In the vibration plate 31, a piezoelectric element 34 accommodated in a storage chamber 33 is disposed on a surface opposite to a portion facing the cavity 25 and in a position different from the reservoir 24. Then, when the piezoelectric element 34 is stretched by receiving a drive signal, the vibration plate 31 vibrates and then a volume of the cavity 25 changes. Thus, the liquid inside the cavity 25 is ejected as liquid droplets from the nozzle 12. In the embodiment, the vibration plate 31, the piezoelectric element 34, the cavity 25, and the nozzle 12 configure the liquid ejecting section 13.

A plurality of the piezoelectric elements 34, the through holes 32, and the cavities 25 are provided so as to individually correspond to the nozzles 12, and the reservoir 24 communicates with the plurality of cavities 25 through the through hole 32. That is, the liquid supplied from the liquid supply source 19 is temporarily retained in the reservoir 24 and then is supplied from the reservoir 24 to each nozzle 12 through the through holes 32 and the cavities 25.

The first filter 21 is accommodated in a first filter chamber 26 that is a width widened section in which a cross-sectional area of the flow path in the supply flow path 14 is enlarged. The pressure adjustment mechanism 22 has a valve chamber 41 and a pressure chamber 42 that are width widened sections in which the cross-sectional area of the flow path in the supply flow path 14 is enlarged. Furthermore, the second filter 23 is accommodated in a second filter chamber 27 that is a width widened section in which the cross-sectional area of the flow path in the supply flow path 14 is enlarged.

The first filter chamber 26 communicates with the valve chamber 41 and the valve chamber 41 communicates with a pressure chamber 42 through a through hole 43. Furthermore, the pressure chamber 42 communicates with the second filter chamber 27 and the second filter chamber 27 communicates with the reservoir 24. Then, the liquid stored in the liquid supply source 19 is pressurized according to the drive of the pressurizing mechanism 15 and enters the valve chamber 41 after being filtered by the first filter 21. Furthermore, the liquid flowing out from the pressure chamber 42 to the second filter chamber 27 enters the reservoir 24 after being filtered by the second filter 23.

Next, a configuration of the pressurizing mechanism 15 and the pressure adjustment mechanism 22 will be described.

The pressurizing mechanism 15 has a pump chamber 28 that is disposed in a position further upstream than the first filter chamber 26, the valve chamber 41, the pressure chamber 42, and the second filter chamber 27 that are the width widened sections. Then, the pressurizing mechanism 15 performs suction drive that sucks the liquid of the liquid supply source 19 into the pump chamber 28 by increasing a volume of the pump chamber 28 and performs ejection drive that causes the liquid inside the pump chamber 28 to flow to the downstream side on which the width widened sections exist by reducing the volume of the pump chamber 28.

The pressure adjustment mechanism 22 includes a valve body 44 that is capable of closing the through hole 43, a biasing member 45 that is accommodated in the valve chamber 41 and biases the valve body 44, and a regulating mechanism 46 that regulates movement of the valve body 44. For example, the biasing member 45 is a spring and biases the valve body 44 from a valve open position in which the through hole 43 is open to a valve closed position in which the through hole 43 is capable of being closed. Then, when the valve body 44 moves from the valve closed position to the valve open position against a biasing force of the biasing member 45, the valve chamber 41 communicates with the pressure chamber 42.

A part (a left side wall in FIG. 1) of a wall surface of the pressure chamber 42 is configured of a flexible film 47. Then, when the liquid in the pressure chamber 42 is decreased by ejecting the liquid from the nozzle 12, the film 47 is deflected and displaced in a direction in which a volume of the pressure chamber 42 is decreased by a pressure difference between a liquid pressure inside the pressure chamber 42 and the atmospheric pressure thereby pressing the valve body 44. Then, if a deflection force of the film 47 is greater than the biasing force of the biasing member 45, the valve body 44 moves from the valve closed position to the valve open position.

When the liquid ejecting section 13 performs an ejecting operation of the liquid, the pressurizing mechanism 15 is driven at a predetermined timing so that the valve chamber 41 is held at a positive pressure of a constant value or more. Thus, the pressure inside the pressure chamber 42 is decreased due to the ejection of the liquid and when the valve body 44 pressed by the film 47 moves to the valve open position, the liquid that is pressurized inside the valve chamber 41 flows into the pressure chamber 42. Furthermore, if the pressure difference between the liquid pressure inside the pressure chamber 42 and the atmosphere pressure by flowing of the liquid into the pressure chamber 42 is cleared, the valve body 44 moves again to the valve closed position by the biasing force of the biasing member 45. As described above, the pressure adjustment mechanism 22 supplies the liquid corresponding to consumption of the liquid to the nozzle 12 by opening and closing the supply flow path 14 based on the pressure difference between the liquid pressure and the atmospheric pressure.

Furthermore, the biasing force of the biasing member 45 is adjusted so as to open the valve if the pressure inside the pressure chamber 42 is less than approximately −0.5 kPa to −1.0 kPa. That is, the pressure adjustment mechanism 22 includes a pressure adjustment function that holds the supply flow path 14 on the downstream side more than the through hole 43 at a negative pressure of approximately −0.5 kPa to −1.0 kPa. The negative pressure prevents the liquid from dripping from the nozzle 12 and stabilizes the ejecting operation by forming meniscuses evenly inside the plurality of nozzles 12.

Next, a configuration of the maintenance mechanism 16 will be described.

The maintenance mechanism 16 includes a cap 51 that is relatively movable with respect to the nozzle forming surface 18 of the liquid ejecting section 13, a waste liquid storage section 52, a waste liquid flow path 53 that connects the cap 51 and the waste liquid storage section 52, a pressure reducing mechanism 54 that is provided in the waste liquid flow path 53, and an atmosphere opening valve 55 attached to the cap 51.

Figure 2:
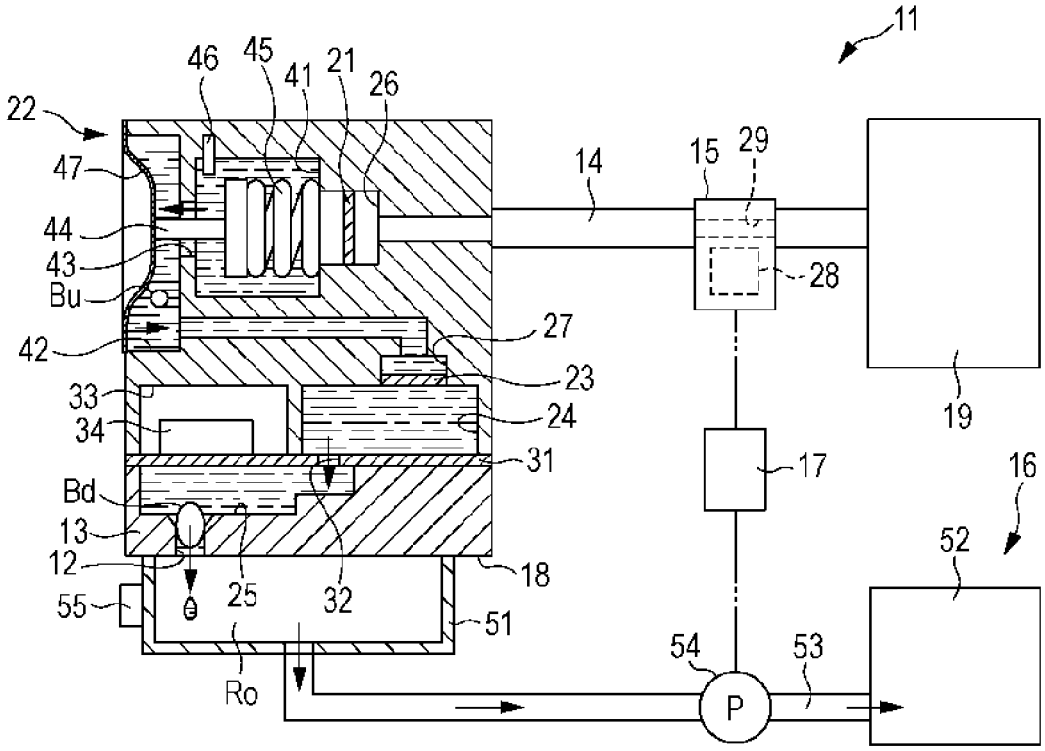
FIG. 2 is a cross-sectional view illustrating the liquid ejecting apparatus in a first discharging process.

As illustrated in FIG. 2, the cap 51 moves to a direction close to the liquid ejecting section 13 and comes into contact with the liquid ejecting section 13 so as to surround a region in which the nozzle 12 is open. Thus, the cap 51 surrounds a space Ro with which the downstream end (an opening section that is the opposite end to the side of the supply flow path 14) of the nozzle 12 communicates.

In the embodiment, an operation in which the cap 51 surrounds the space Ro with which the nozzle 12 communicates is referred to as "capping". Moreover, the cap 51 is not limited to the bottomed box shape having the opening section as illustrated in FIG. 2 and, for example, a circular elastic member surrounding a region in which the nozzle 12 is open may be disposed in the nozzle forming surface 18, and the cap 51 may be a planar member surrounding the space Ro by coming into contact with the elastic member.

When capping the liquid ejecting section 13, if the atmosphere opening valve 55 is in a valve open state, the space Ro is open to the atmosphere and if the atmosphere opening valve 55 is in a valve closed state, the space Ro is in a substantially closed state. Thus, when driving the pressure reducing mechanism 54 in a state where the liquid ejecting section 13 is capped and the atmosphere opening valve 55 is in the valve closed state, the pressure is reduced inside the space Ro and a negative pressure is generated, and the liquid inside the supply flow path 14 is discharged through the nozzle 12. That is, the pressure reducing mechanism 54 discharges the liquid from the nozzle 12 by reducing the pressure of the space communicating with a side opposite to the side of the supply flow path 14 of the nozzle 12. Moreover, the pressure reducing mechanism 54 is capable of switching between an allowing state in which the flow of the waste liquid inside the waste liquid flow path 53 is allowed and a regulating state in which the flow of the waste liquid is regulated in a state where the drive is stopped. Furthermore, the waste liquid storage section 52 is open to the atmosphere.

When the inside of the space Ro is brought into a negative pressure state by the drive of the pressure reducing mechanism 54 and the liquid is sucked and discharged from the nozzle 12, the liquid is caused to flow out from the pressure chamber 42 and then the valve body 44 is brought into the valve open state. Then, when the valve body 44 is in the valve open state, if driving the regulating mechanism 46 of the pressure adjustment mechanism 22, since movement of the valve body 44 in the valve open state to the valve closed position is regulated, a state (a state illustrated in FIGS. 3 and 4) where the pressure chamber 42 communicates with the valve chamber 41 is held. Moreover, the regulating mechanism 46 may regulate the movement of the valve body 44 when the valve body 44 is in the valve open position and may regulate the movement of the valve body 44 to the valve closed position, after forcibly moving the valve body 44 that is in the valve closed state to the valve open position by applying an external force and the like from the outside of the film 47.

In the embodiment, even when not driving the pressurizing mechanism 15, the supply flow path 14 may be provided with a communication flow path 29 that allows the upstream side of the pump chamber 28 to communicate with the downstream side. Thus, if influence of the negative pressure generated by the drive of the pressure reducing mechanism 54 reaches the upstream side of the pump chamber 28 through the communication flow path 29, the liquid stored in the liquid supply source 19 flows out toward the downstream side through the communication flow path 29 even if the pressurizing mechanism 15 is not driven. Moreover, it is preferable that a check valve regulating the flow of the liquid to the upstream side be provided in the communication flow path 29.

Next, a maintenance operation of the liquid ejecting apparatus 11 will be described.

The control section 17 performs the maintenance operation (cleaning operation) that discharges the liquid from the nozzle 12 by driving at least one of the pressurizing mechanism 15 and the pressure reducing mechanism 54 to prevent or eliminate ejection failure of the liquid in the liquid ejecting section 13. Moreover, as described above, the liquid discharged from the nozzle 12 for maintenance rather than ejecting the liquid to the medium refers to waste liquid. Furthermore, the waste liquid discharged from the nozzle 12 into the cap 51 in response to the maintenance operation is stored in the waste liquid storage section 52 through the waste liquid flow path 53.

Here, a cause of failure of the discharge of the liquid includes mixing of the air bubbles into the supply flow path 14, in addition to the clogging of the nozzle 12. Specifically, if air bubbles are mixed into the supply flow path 14, for example, the air bubbles become caught in obstacles such as the filters 21 and 23, the biasing member 45, and the like, and the air bubbles may be retained in the width widened sections (the filter chambers 26 and 27, the valve chamber 41, the pressure chamber 42, and the like) in which a cross-sectional area of the flow path is widened in the supply flow path 14. Then, as described above, if the air bubbles remain in the supply flow path 14, the air bubbles are gathered each other and then the size of the air bubbles gradually increases. Furthermore, as described above, if large air bubbles enter the cavity 25 or the nozzle 12, there is a concern that discharge failure in which the liquid droplets are not appropriately ejected even if the vibration plate 31 vibrates may occur, leading to a decrease in printing quality such as missing dots.

Then, in the liquid ejecting apparatus 11, for example, the maintenance operation is performed at a predetermined timing of before or after the printing operation and the liquid or the air bubbles that are thickened inside the supply flow path 14 are disposed together with the liquid. Moreover, as illustrated in FIG. 2, if the liquid is sucked from the nozzle 12 by driving only the pressure reducing mechanism 54, specifically, since an air bubble Bd that is in the downstream portion (for example, the reservoir 24, the cavity 25, or the like) of the supply flow path 14 is sucked and expanded, the air bubble Bd is likely to be swept away by the flowing first. Thus, specifically, it is possible to efficiently discharge the air bubble Bd that is in the downstream portion of the supply flow path 14 by sucking and discharging of the liquid by the drive of the pressure reducing mechanism 54.

However, as illustrated in FIG. 1, an air bubble Bu that is in the upstream portion (for example, the first filter chamber 26, the pressure adjustment mechanism 22, or the like) of the supply flow path 14 is likely to be caught by obstacles in the middle of the supply flow path 14 by being expanded by the operation of the negative pressure and may not flow down to the nozzle 12 until the maintenance operation is completed.

Figure 3:
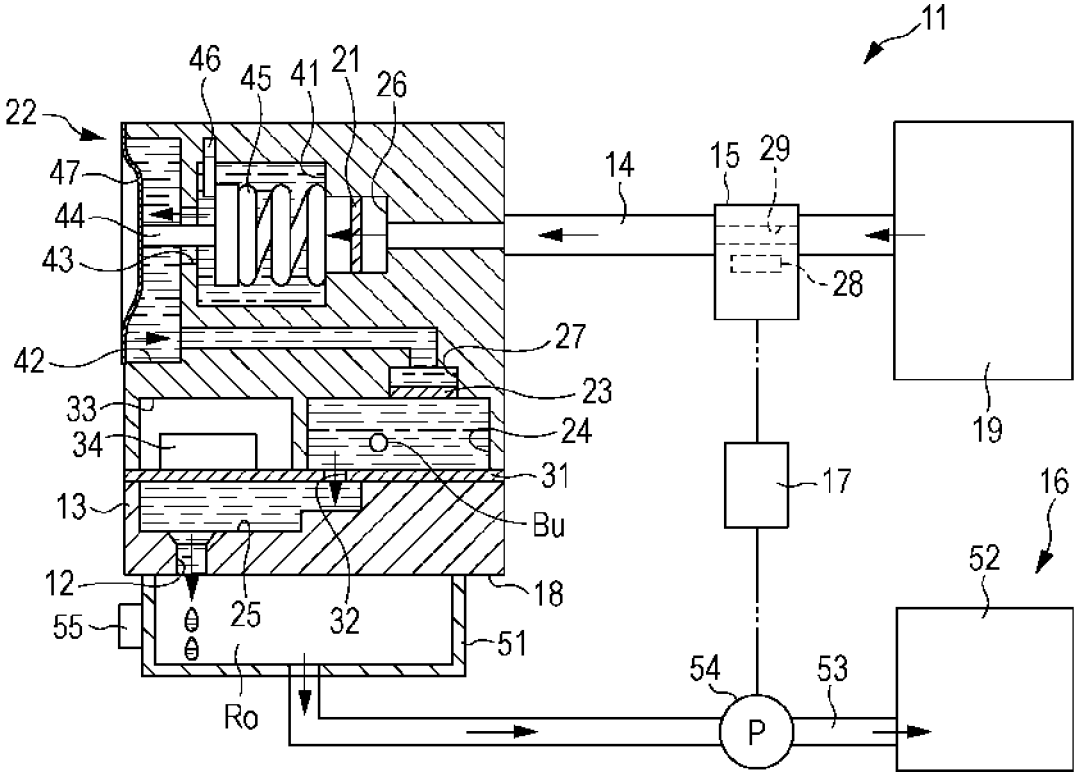
FIG. 3 is a cross-sectional view illustrating the liquid ejecting apparatus in a second discharging process.

In this regard, as illustrated in FIG. 3, when driving the pressure reducing mechanism 54 and the pressurizing mechanism 15 at the same time, it is possible to sweep away the air bubble Bu that is in the upstream portion to the downstream side while discharging the air bubbles that are in the downstream portion of the supply flow path 14 by sucking the air bubbles. That is, the pressurizing mechanism 15 discharges the liquid from the nozzle 12 by pressurizing the liquid inside the supply flow path 14. Moreover, when performing the discharging operation of the liquid by the pressurizing of the pressurizing mechanism 15, the valve body 44 is held in the valve open position by driving the regulating mechanism 46 of the pressure adjustment mechanism 22. In this way, it is possible to discharge the pressurized liquid from the nozzle 12 by allowing the liquid to flow from the valve chamber 41 to the pressure chamber 42 regardless of the liquid pressure inside the pressure chamber 42.

Here, the negative pressure caused to act on the supply flow path 14 by the drive of the pressure reducing mechanism 54 is approximately −80 kPa and the positive pressure operating on the supply flow path 14 by the drive of the pressurizing mechanism 15 is approximately 20 kPa to 30 kPa. In this case, it is possible to cause the liquid to flow due to the pressure of approximately 100 kPa to 110 kPa that is a difference between the negative pressure generated by the pressure reducing mechanism 54 and the positive pressure generated by the pressurizing mechanism 15 by driving both the pressure reducing mechanism 54 and the pressurizing mechanism 15 at the same time.

On the other hand, when applying the pressure (for example, the pressure of approximately 100 kPa to 110 kPa) corresponding to the pressure difference between the positive pressure and the negative pressure only by pressurization or only by the pressure reduction, the pressure difference between the inside of the supply flow path 14 and the outside thereof increases. Thus, there is a concern that a load on the supply flow path may increase thereby leading to the leakage of the liquid or the deformation of the supply flow path 14.

Regarding this point, it is possible to increase a flow rate by increasing the pressure operating on the liquid while suppressing the load on the supply flow path 14 by driving both the pressure reducing mechanism 54 and the pressurizing mechanism 15 at the same time. Moreover, since it is necessary to maintain a constant flow rate or more to cause the air bubbles to flow in the supply flow path 14, a discharge property of the air bubbles are improved if the flow rate of the liquid is fast.

However, if the flow rate of the liquid is faster, an amount of the liquid discharged per unit time increases. Then, when discharging the liquid by such a maintenance operation, since the liquid to be used for printing is consumed, accordingly, it is preferable that the discharge amount of the liquid according to the maintenance operation be decreased. Thus, the control section 17 allows an initial discharging operation of the maintenance operation to be performed only by driving the pressure reducing mechanism 54 as illustrated in FIG. 2. Therefore, the air bubbles specifically in the downstream portion of the supply flow path 14 are efficiently discharged while suppressing the increase in the discharge amount of the liquid.

Figure 4:
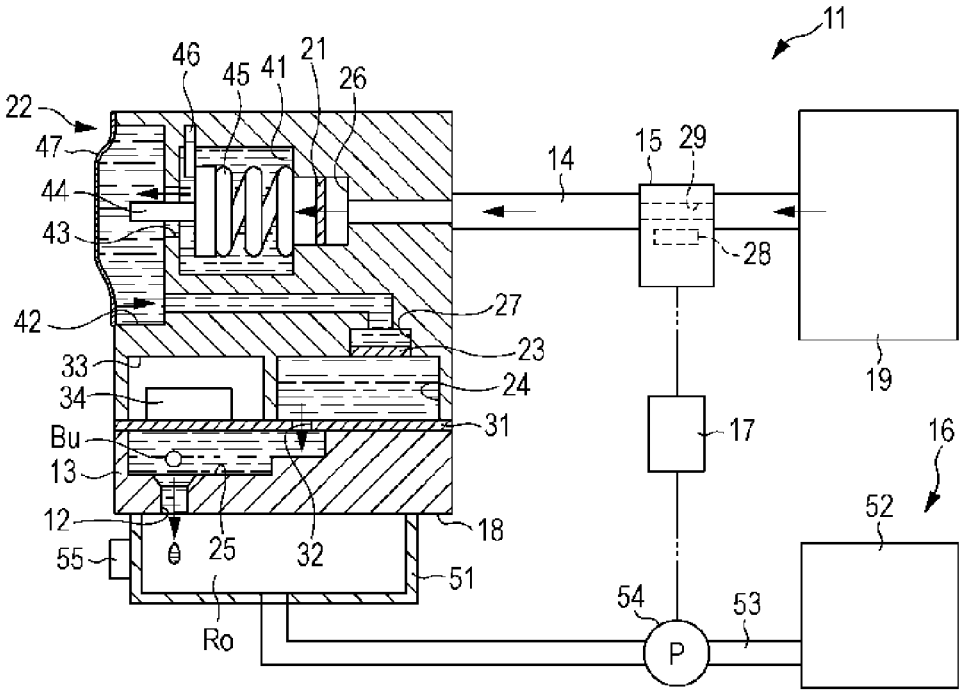
FIG. 4 is a cross-sectional view illustrating the liquid ejecting apparatus in a third discharging process.

Furthermore, as illustrated in FIG. 4, the control section 17 allows the last discharging operation of the maintenance operation to be driven only by the pressurizing mechanism 15. Therefore, the air bubbles are removed from an entirety of the supply flow path 14 while suppressing the increase in the discharge amount of the liquid.

That is, when the negative pressure is caused to act on the liquid inside the nozzle 12 by driving the pressure reducing mechanism 54, since the air bubbles mixed into the supply flow path 14 are expanded, specifically, the air bubbles in the downstream portion of the supply flow path 14 are likely to be discharged from the nozzle 12 together with the liquid. However, when the negative pressure is caused to act on the inside of the supply flow path 14 by driving the pressure reducing mechanism 54, gas dissolved in the liquid becomes air bubbles and appears as air bubbles. Then, the air bubbles appearing in the upstream portion of the supply flow path 14 about at the time of an end of the maintenance operation may remain in the supply flow path 14 after the maintenance operation. The air bubbles do not remain in the supply flow path 14 due to performing the last discharging operation of the maintenance operation only by driving the pressurizing mechanism 15.

Next, in order to perform the maintenance operation, a processing routine that is performed after capping by the control section 17 will be described.

Figure 5:
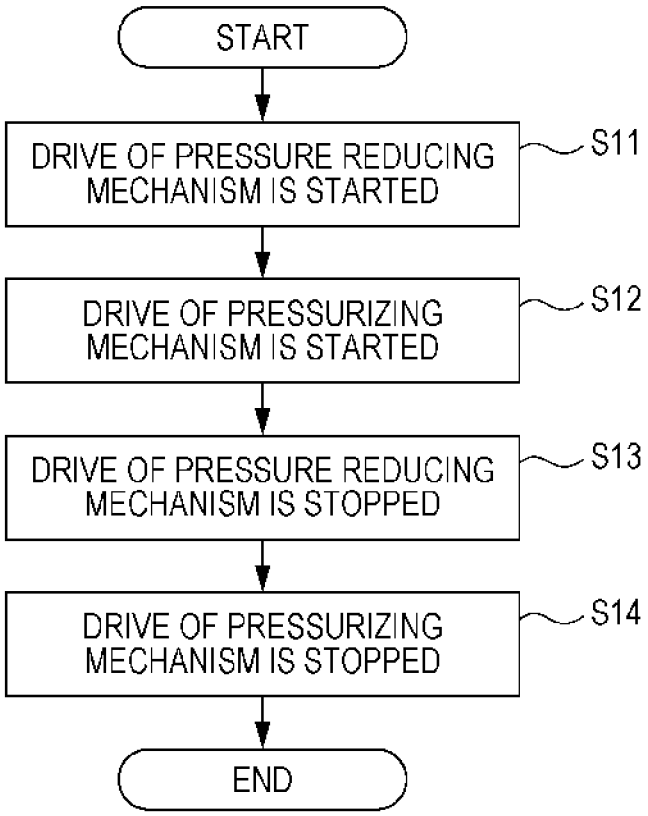
FIG. 5 is a flowchart illustrating an executing sequence of a maintenance operation.

As illustrated in FIG. 5, in step S11, the control section 17 allows the drive of the pressure reducing mechanism 54 to be started. Therefore, the inside of the space Ro is brought into a negative pressure state and the liquid is sucked and discharged from the nozzle 12. Furthermore, if the negative pressure generated by the drive of the pressure reducing mechanism 54 reaches the pressure chamber 42, the valve body 44 moves to the valve open position and the liquid that is pressurized on the inside of the valve chamber 41 flows to the downstream side.

In step S12, the control section 17 allows the drive of the pressurizing mechanism 15 to be started. Therefore, since the ink is also pressurized and supplied from the side of the liquid supply source 19, in addition to the suction by the pressure reducing mechanism 54, the flow rate of the liquid flowing in the supply flow path 14 increases.

Next, in step S13, the control section 17 allows the drive of the pressure reducing mechanism 54 to be stopped. Therefore, the liquid is pressurized and supplied to the supply flow path 14 only by driving the pressurizing mechanism 15 from the state where the negative pressure is caused to act on the side of the nozzle 12, thereby discharging the liquid from the nozzle 12.

Then, in step S14, the control section 17 allows the drive of the pressurizing mechanism 15 to be stopped and the process is completed.

Next, operations of the liquid ejecting apparatus 11 having such a configuration and a maintenance method in the liquid ejecting apparatus 11 will be described.

Figure 6:
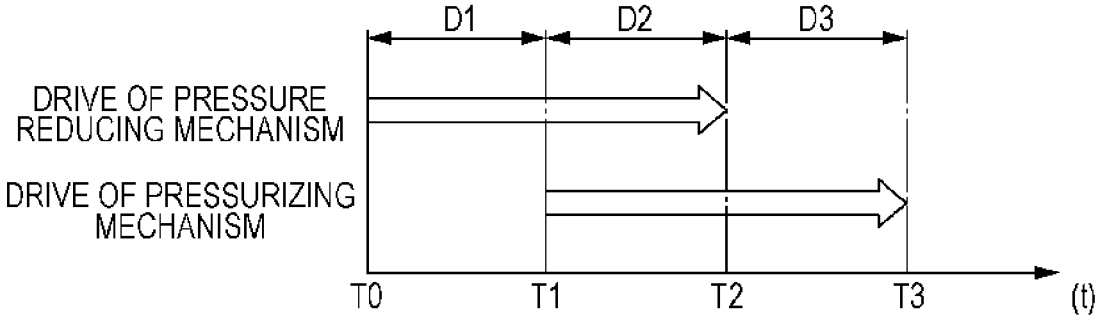
FIG. 6 is a graph illustrating a drive timing of a pressurizing mechanism and a pressure reducing mechanism in the maintenance operation.

As illustrated in FIG. 6, the maintenance operation of the embodiment is divided into a first discharging process D1 in which the liquid is discharged from the nozzle 12 only by driving the pressure reducing mechanism 54, a second discharging process D2 in which the liquid is discharged from the nozzle 12 by driving the pressurizing mechanism 15 and the pressure reducing mechanism 54, and a third discharging process D3 in which the liquid is discharged from the nozzle 12 only by driving the pressurizing mechanism 15.

Then, since the first discharging process D1 in which the first discharging operation of the maintenance operation is performed is a pressure reducing process of only driving the pressure reducing mechanism 54 without driving the pressurizing mechanism 15, the negative pressure is caused to act on the inside of the supply flow path 14, thereby expanding the air bubble Bd mixed into the liquid as illustrated in FIG. 2. Therefore, since the air bubble Bd is likely to flow together with the flowing liquid, specifically, the air bubble Bd in the downstream portion of the supply flow path 14 is efficiently discharged.

Furthermore, in the maintenance operation, in the second discharging process D2 in which the discharging operation is performed between the first discharging operation and the last discharging operation, as illustrated in FIG. 3, the flow rate of the liquid flowing in the supply flow path 14 is fast by driving both the pressurizing mechanism 15 and the pressure reducing mechanism 54, thereby causing the air bubbles to flow to the downstream side. At this time, if the liquid pressure inside the supply flow path 14 is higher than the atmospheric pressure, since there is a concern that the liquid may be leak out, it is preferable that the negative pressure applied by the pressure reducing mechanism 54 be greater than the positive pressure applied by the pressurizing mechanism 15.

Furthermore, in the third discharging process D3 in which the last discharging operation of the maintenance operation is performed, as illustrated in FIG. 4, the discharging operation is performed only by stopping the drive of the pressure reducing mechanism 54 and driving the pressurizing mechanism 15 thereby sweeping away the air bubble Bu in the supply flow path 14 toward the nozzle 12 while suppressing the generation or expansion of the air bubbles in the upstream portion. That is, in the last discharging operation, the discharge of the air bubbles appearing in the supply flow path 14 is performed by sucking the air bubbles by pressurizing and supplying the liquid without causing the negative pressure to act on the liquid in the supply flow path 14.

Then, it is possible to remove the air bubbles from an entirety of the supply flow path 14 while suppressing the increase in consumption of the liquid according to the maintenance operation by performing the discharging operation of the liquid step by step as described above. Furthermore, since the air bubbles are not generated in the upstream portion of the supply flow path 14 at the end of the maintenance operation, the air bubbles remaining in the supply flow path 14 after performing the maintenance are reduced.

Moreover, as illustrated in FIG. 6, when a start time point of the first discharging process D1 is T0 and a start time point of the second discharging process D2 is T1, a time from the time point T0 to the time point T1 is a duration of the first discharging process D1. Then, it is possible to arbitrarily change the duration of the first discharging process D1. Here, when lengthening the duration of the first discharging process D1, since the operation of the negative pressure reaches the upstream side of the supply flow path 14, an effect that the air bubbles are expanded on the inside of the supply flow path 14 or the air bubbles caught by the obstacles are released from the obstacles is increased.

However, when lengthening the duration of the first discharging process D1, the air bubbles in the upstream portion of the supply flow path 14 are expanded and are likely to be caught by the obstacles, or the gas dissolved in the liquid appears as air bubbles. Thus, it is preferable that the duration of the first discharging process D1 be set to be an appropriate value to discharge the air bubbles in the downstream portion of the supply flow path 14 specifically, while considering a flow path configuration of the supply flow path 14.

Furthermore, when a start time point of the third discharging process D3 is T2 and a finish time point of the third discharging process D3 is T3, a time from the time point T1 to the time point T2 is a duration of the second discharging process D2 and a time from the time point T2 to the time point T3 is a duration of the third discharging process D3.

It is possible to arbitrarily change the duration of the second discharging process D2. For example, when lengthening the duration of the second discharging process D2, since a state where the flow rate of the liquid flowing in the supply flow path 14 is fast continues for a longer time, the discharge property of the liquid is improved. On the other hand, when shortening the duration of the second discharging process D2, the amount of the liquid consumed according to the maintenance operation decreases.

It is possible to arbitrarily change the duration of the third discharging process D3. However, in the third discharging process D3, the liquid discharged from the nozzle 12 by the pressurization enters the cap 51, but the flow of the liquid from the cap 51 to the waste liquid flow path 53 stagnates according to the stopping of the drive of the pressure reducing mechanism 54 even in the allowing state in which the pressure reducing mechanism 54 allows the flow of the waste liquid in the waste liquid flow path 53. Furthermore, when excessively pressurizing the inside of the supply flow path 14, since this leads to leakage of the liquid, it is unfavorable.

Thus, it is preferable that the duration of the third discharging process D3 be given a length in which the air bubbles of the upstream portion of the supply flow path 14 can be discharged from the nozzle 12. Furthermore, in the third discharging process D3, for the purpose of discharging the liquid inside the cap 51 to the waste liquid storage section 52, it is possible to drive the pressure reducing mechanism 54 to the extent that the air bubbles do not appear inside the supply flow path 14.

That is, the expression "the last discharging operation of the maintenance operation is performed only by driving the pressurizing mechanism 15" indicates that the liquid is not actively sucked and discharged from the nozzle 12 by driving the pressure reducing mechanism 54 in the last discharging operation and is not defined as a configuration in which the drive of the pressure reducing mechanism 54 itself is not performed at all in the third discharging process D3.

Furthermore, the expression "the first discharging operation is performed only by the pressure reducing mechanism 54 in the maintenance operation" indicates that the discharge of the liquid from the nozzle 12 is not actively performed while pressurizing and supplying the liquid by the pressurizing mechanism 15 in the first discharging operation. That is, when the valve body 44 is in the valve closed position, for example, even if the pressurizing mechanism 15 is driven to hold the valve chamber 41 at a constant positive pressure or more, since the pressurizing force does not directly contribute to the discharge of the liquid from the nozzle 12, the pressurizing mechanism 15 is not driven for the discharging operation in the first discharging process D1.

According to the above embodiment, it is possible to obtain the following effects.

(1) Since the liquid is pressurized and discharged by driving the pressurizing mechanism 15 without performing the suction and discharge of the liquid by the pressure reducing mechanism 54 in the end of the maintenance operation, the air bubbles are not generated about at the time of the end of the maintenance operation and the air bubbles inside the supply flow path 14 are swept away to the downstream side, and the air bubbles can be discharged from the nozzle 12 together with the liquid. Therefore, it is possible to reduce the air bubbles remaining in the supply flow path 14 that supplies the liquid to the nozzle 12 after performing the maintenance in which the liquid is discharged from the nozzle 12.

(2) It is possible to efficiently expand the air bubbles in the supply flow path 14 by performing the first discharging operation of the maintenance operation by driving the pressure reducing mechanism 54. Therefore, it is possible to efficiently discharge the air bubbles according to the discharge of the liquid.

(3) In the second discharging process D2, the pressure corresponding to the pressure difference between the positive pressure generated by the pressurization of the pressurizing mechanism 15 and the negative pressure generated by the pressure reduction of the pressure reducing mechanism 54 is applied to the liquid inside the supply flow path 14 by driving both the pressurizing mechanism 15 and the pressure reducing mechanism 54. As described above, when applying the pressure corresponding to the pressure difference between the positive pressure and the negative pressure only by the pressurization or only by the pressure reduction, the pressure difference between the inside of the supply flow path 14 and the outside thereof increases. Thus, there is a concern that the load on the supply flow path 14 may increase thereby leading to the leakage of the liquid or the deformation and the like of the supply flow path 14. On the other hand, it is possible to improve the discharge property of the air bubbles by increasing the flow rate of the liquid while suppressing the load applied to the supply flow path 14 by causing the pressure difference between the positive pressure and the negative pressure to act on the liquid inside the supply flow path 14 by driving both the pressurizing mechanism 15 and the pressure reducing mechanism 54 at the same time.

(4) Since the first filter chamber 26, the valve chamber 41, the pressure chamber 42, and the second filter chamber 27 that are the width widened sections are enlarged in the cross-sectional areas of the flow path, the air bubbles are likely to be accumulated, but it is possible to efficiently sweep away the air bubbles accumulated in the width widened sections to the downstream side of the nozzle 12 by pressurizing and supplying the liquid from further upstream than the width widened sections by the pressurizing mechanism 15.

(5) Since the pressurizing mechanism 15 that is used to eject the liquid and supplies the liquid to the nozzle 12 can serve as the pressurizing mechanism for the maintenance operation, it is not necessary to separately provide the pressurizing mechanism for the maintenance operation.

Moreover, the above embodiment may be changed as described below.

The first discharging process D1 is omitted and both the pressurizing mechanism 15 and the pressure reducing mechanism 54 may be driven from the beginning of the maintenance operation. According to the configuration, since the flow rate of the liquid flowing in the supply flow path 14 quickly reaches a target flow rate at which the air bubbles are capable of being discharged, it is possible to decrease the amount of liquid consumed before reaching the target flow rate.

For example, if there are few width widened sections or obstacles in the supply flow path 14 and the air bubbles can be discharged without increasing the flow rate of the liquid, the second discharging process D2 is omitted and stopping of the drive of the pressure reducing mechanism 54 and starting of the drive of the pressurizing mechanism 15 may be performed at the same time. According to the configuration, it is preferable because it is possible to decrease the consumption amount of the liquid according to the maintenance operation.

It is possible to change the duration of respective discharging processes D1 to D3, presence or absence of the discharging processes D1 and D2, or the like depending on the timing at which the maintenance operation is performed or the purpose thereof. For example, if the discharge failure of the liquid is eliminated, the duration of the discharging processes D1 to D3 is lengthened and if the maintenance operation is preventively performed, the duration of the discharging processes D1 to D3 is shortened or the first discharging process D1 or the second discharging process D2 may be omitted.

In the third discharging process D3, it is possible to perform the discharge of the liquid from the inside of the cap 51 by changing the drive of the pressure reducing mechanism 54 to an extent that the inside of the cap 51 is not in the negative pressure state in the second discharging process D2 without stopping the drive of the pressure reducing mechanism 54. Furthermore, in the third discharging process D3, after the negative pressure inside the cap 51 is eliminated by the drive of the pressurizing mechanism 15, the inside of the cap 51 may be opened to the atmosphere by making the atmosphere opening valve 55 be in the valve open state or by releasing a contact state (a capping state) of the cap 51 with the liquid ejecting section 13. According to the configuration, in the third discharging process D3, even if the pressure reducing mechanism 54 is driven, the negative pressure is not caused to act on the liquid inside the supply flow path 14. Furthermore, even after the drive of the pressurizing mechanism 15 is stopped in the third discharging process D3, the drive of the pressure reducing mechanism 54 is continued and then the drive of the pressure reducing mechanism 54 may be stopped after the liquid inside the cap 51 is discharged to the waste liquid storage section 52. According to the configuration, it is possible to continuously perform the third discharging process D3 and then the discharging operation of the liquid from the inside of the cap 51.

The configuration of the flow path of the supply flow path 14 is not limited to the above embodiments. For example, it is possible to have a configuration in which the filters 21 and 23, the filter chambers 26 and 27, or the pressure adjustment mechanism 22 is not included.

The liquid supply source 19 may be a bag having flexibility accommodated in a case having rigidity. Then, when employing the configuration, the liquid inside the bag may flow out to the supply flow path 14 by pressurizing a space outside the bag inside the case or by pressurizing the liquid inside the bag by crushing the bag by, for example, a biasing member such as a spring. That is, when employing the configuration, the pressurizing mechanism 15 may not include the pump chamber 28 configuring the supply flow path 14.

If the liquid for printing is supplied from the liquid supply source 19 to the nozzle 12 by a water head difference between the liquid supply source 19 and the liquid ejecting section 13, and the like, it is possible to separately include a pressurizing mechanism for performing the maintenance operation.

The liquid ejecting apparatus may be a printer only having the printing function and may be a printer provided in a facsimile, a copying apparatus, or a composite machine including these apparatuses.

The liquid that is ejected by the liquid ejecting section 13 may be a fluid (a liquid, a liquid body in which particles of a functional material are dispersed or mixed into a liquid, a fluid-like material such as a gel, a solid that can be ejected by flowing as a fluid) other than the ink. For example, it may be configured to eject a liquid body including a material such as an electrode material or a color material (pixel material) used for manufacturing of a liquid crystal display, an electroluminescence (EL) display, and a surface-emitting display in a dispersed or dissolved form.

The entire disclosure of Japanese Patent Application No. 2013-235376, filed Nov. 13, 2013 is expressly incorporated by reference herein.

What is claimed is:

1. A liquid ejecting apparatus comprising:

a liquid ejecting section in which a nozzle capable of ejecting liquid is provided;

a pressurizing mechanism that discharges the liquid from the nozzle by pressurizing the liquid inside the supply flow path supplying the liquid to the nozzle; and a pressure reducing mechanism that discharges the liquid from the nozzle by reducing a pressure of a space communicating with a side opposite to a side of the supply flow path of the nozzle, a controller that is communicatively coupled to the pressurizing mechanism and the pressure reducing mechanism, wherein the controller performs a maintenance operation that discharges the liquid from the nozzle by driving at least one of the pressurizing mechanism and the pressure reducing mechanism, and the controller performs a last discharging operation of the maintenance operation by driving the pressurizing mechanism from a state where the negative pressure is caused to act inside the nozzle by driving the pressure reducing mechanism.

2. The liquid ejecting apparatus according to claim 1, wherein the controller performs a first discharging of the maintenance operation by driving the pressure reducing mechanism.

3. The liquid ejecting apparatus according to claim 2, wherein the controller performs the discharging operation between the first discharging operation and the last discharging operation by driving the pressurizing mechanism and the pressure reducing mechanism.

4. The liquid ejecting apparatus according to claim 1, wherein an upstream end of the supply flow path is connected to a liquid supply source and the supply flow path is provided with a width widened section in which a cross-sectional area of the flow path is widened, and wherein the pressurizing mechanism is disposed in a position further upstream than the width widened section in the supply flow path.

* * * * *